US007453476B2

(12) United States Patent
Kim

(10) Patent No.: US 7,453,476 B2
(45) Date of Patent: Nov. 18, 2008

(54) APPARATUS FOR DRIVING DISCHARGE DISPLAY PANEL USING DUAL SUBFIELD CODING

(75) Inventor: Joon-Koo Kim, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 623 days.

(21) Appl. No.: 11/104,527

(22) Filed: Apr. 13, 2005

(65) Prior Publication Data

US 2005/0231441 A1 Oct. 20, 2005

(30) Foreign Application Priority Data

Apr. 14, 2004 (KR) ..... 10-2004-0025677

(51) Int. Cl.
*G09G 5/10* (2006.01)
*G09G 3/28* (2006.01)

(52) U.S. Cl. ..... 345/690; 345/72

(58) Field of Classification Search ..... 345/60–72, 345/690–692

See application file for complete search history.

(56) References Cited

U.S. PATENT DOCUMENTS 5,541,618 A 7/1996 Shinoda ..... 345/60

FOREIGN PATENT DOCUMENTS

| | | |
|---|---|---|
| JP | 11-175025 | 7/1999 |
| JP | 1999-194742 | 7/1999 |
| KR | 10-2001-0020046 | 3/2001 |
| KR | 2002-0089521 | 11/2002 |

*Primary Examiner*—Amare Mengistu
*Assistant Examiner*—Randal Willis
(74) *Attorney, Agent, or Firm*—H.C. Park & Associates, PLC

(57) ABSTRACT

An apparatus for driving a discharge display panel using dual subfield coding, which can prevent a gradient low discharge effect due to an address discharge failure by performing a subfield gradient weight design, by which a subfield gradient has a plurality of redundancies in all gradients except gradients having the lowest gradient weight and the highest gradient weight, and a dynamic dual subfield coding. The apparatus divides an image signal into frame units, obtains an input gradient of a frame from the image signal, performs a time division gradient display on the discharge display panel according to the input gradient by dividing the frame into a plurality of subfields having respective gradient weights, and has at least two subfields having a least gradient weight.

11 Claims, 9 Drawing Sheets

| GRADIENT | SUBFIELD CODING |
|---|---|
| 50 | 1001110000 |
| 51 | 0101110000 |
| 52 | 1101110000 |
| 53 | 0011110000 |
| 54 | 1011110000 |
| 55 | 0111110000 |
| 56 | 1111110000 |
| 57 | 0110101000 |
| 58 | 1110101000 |
| 59 | 0001101000 |
| 60 | 1001101000 |
| 61 | 0101101000 |
| 62 | 1101101000 |
| 63 | 0011101000 |
| 64 | 1011101000 |

FIG. 10

| GRADIENT | FIRST SUBFIELD CODING | SECOND SUBFIELD CODING |
|---|---|---|
| 50 | 01001110000 | 10001110000 |
| 51 | 11001110000 | 00101110000 |
| 52 | 01101110000 | 10101110000 |
| 53 | 11101110000 | 00011110000 |
| 54 | 01011110000 | 10011110000 |
| 55 | 11011110000 | 00111110000 |
| 56 | 01111110000 | 10111110000 |
| 57 | 11111110000 | 00110101000 |
| 58 | 01110101000 | 10110101000 |
| 59 | 11110101000 | 00001101000 |
| 60 | 01001101000 | 10001101000 |
| 61 | 11001101000 | 00101101000 |
| 62 | 01101101000 | 10101101000 |
| 63 | 11101101000 | 00011101000 |
| 64 | 01011101000 | 10011101000 |

APPARATUS FOR DRIVING DISCHARGE DISPLAY PANEL USING DUAL SUBFIELD CODING

CROSS REFERENCE TO RELATED APPLICATION

This application claims priority to and the benefit of Korean Patent Application No. 10-2004-0025677, filed on Apr. 14, 2004, which is hereby incorporated by reference for all purposes as if fully set forth herein.

BACKGROUND OF THE INVENTION

1. Field of the Invention

The present invention relates to an apparatus for driving a discharge display panel, and more particularly, to an apparatus for driving a discharge display panel using dual subfield coding.

2. Discussion of the Background

Generally, a plasma display panel (PDP) displays images by gas discharge. FIG. 1 is an internal perspective view showing a structure of a conventional three-electrode surface discharge PDP.

Referring to FIG. 1, a conventional surface discharge PDP 1 may include address electrode lines $A_{R1}, A_{G1}, \ldots, A_{Gm}, A_{Bm}$, dielectric layers 11 and 15, Y electrode lines $Y_1, \ldots, Y_n$, X electrode lines $X_1, \ldots, X_n$, a fluorescent layer 16, barrier ribs 17, and a magnesium oxide MgO layer 12 forming a protective film between upper and lower glass substrates 10 and 13.

The address electrode lines $A_{R1}, A_{G1}, \ldots, A_{Gm}, A_{Bm}$ are formed on the lower glass substrate 13 in a predetermined pattern, and a lower dielectric layer 15 covers the address electrode lines $A_{R1}, A_{G1}, \ldots, A_{Gm}, A_{Bm}$. The barrier ribs 17 may be formed on the lower dielectric layer 15 in parallel to the address electrode lines $A_{R1}, A_{G1}, \ldots, A_{Gm}, A_{Bm}$. The barrier ribs 17 partition a discharge space 14 to define discharge cells and prevent optical cross talk between adjacent discharge cells. The fluorescent layer 16 is formed on the lower dielectric layer 15 and on sides of the barrier ribs 17.

The X electrode lines $X_1, \ldots, X_n$ and the Y electrode lines $Y_1, \ldots, Y_n$ are formed in pairs on a surface of the upper glass substrate 10 facing the lower glass substrate 13, and they extend in a direction substantially perpendicular to the address electrode lines $A_{R1}, A_{G1}, \ldots, A_{Gm}, A_{Bm}$. Each intersection of an address electrode with an X and Y electrode pair corresponds to a discharge cell. The X electrode lines $X_1, \ldots, X_n$ and the Y electrode lines $Y_1, \ldots, Y_n$ may comprise transparent electrode lines made of a transparent, conductive material, such as indium tin oxide (ITO), and metal electrode lines for increasing conductivity of the transparent lines. The upper dielectric layer 11 covers the X electrode lines $X_1, \ldots, X_n$ and the Y electrode lines $Y_1, \ldots, Y_n$. The protective layer 12, which protects the PDP 1 from a strong electric field, covers the upper dielectric layer 11. A plasma forming gas is sealed in the discharge space 14.

U.S. Pat. No. 5,541,618 discloses a method of driving a PDP such as the PDP 1 of FIG. 1.

FIG. 2 is a timing graph showing a conventional driving method for the PDP of FIG. 1.

Referring to FIG. 2, a unit frame may be divided into 8 subfields SF1, . . . , SF8 in order to realize time division gradient display. The subfields SF1, . . . , SF8 may be further divided into reset periods R1, . . . , R8, addressing periods A1, . . . , A8, and sustain discharge periods S1, . . . , S8.

The PDP's brightness is directly proportional to the length of the sustain discharge periods S1, . . . , S8 in the unit frame. In FIG. 2, the length of the sustain discharge periods S1, . . . , S8 per unit frame is 255T (T is a unit time), and a sustain discharge period Sn of an n# subfield SFn is set to a time corresponding to $2^{n-1}$. Accordingly, a total 256 gradients, including gradient 0, may be performed by properly selecting subfields to be displayed among the 8 subfields.

FIG. 3 shows driving signals that may be applied to electrode lines of the PDP 1 of FIG. 1 in a unit subfield of FIG. 2.

Referring to FIG. 3, $S_{AR1 \ldots ABm}$ indicates driving signals applied to the address electrode lines $A_{R1}, A_{G1}, \ldots, A_{Gm}, A_{Bm}$, $S_{X1 \ldots Xn}$ indicates driving signals applied to the X electrode lines $X_1, \ldots, X_n$, and $S_{Y1} \ldots S_{Yn}$ indicates driving signals applied to the Y electrode lines $Y_1, \ldots, Y_n$.

During a reset period PR of a unit subfield SF, a voltage supplied to the X electrode lines $X_1, \ldots, X_n$ may increase from a ground voltage $V_G$ to a first voltage $V_e$, e.g., to 155V. At this time, the Y electrode lines $Y_1, \ldots, Y_n$ and the address electrode lines $A_{R1}, A_{G1}, \ldots, A_{Gm}, A_{Bm}$ may be biased at the ground voltage $V_G$.

Next, a voltage supplied to the Y electrode lines $Y_1, \ldots, Y_n$ may increase from a second voltage $V_S$, e.g., 155V, to a voltage $V_{SET}+V_S$, e.g., to 355V, which is obtained by adding the second voltage $V_S$ to a third voltage $V_{SET}$. At this time, the X electrode lines $X_1, \ldots, X_n$ and the address electrode lines $A_{R1}, A_{G1}, \ldots, A_{Gm}, A_{Bm}$ may be biased at the ground voltage $V_G$.

Then, while biasing the X electrode lines $X_1, \ldots, X_n$ at the first voltage $V_e$ and the address electrode lines $A_{R1}, A_{G1}, \ldots, A_{Gm}, A_{Bm}$ at the ground voltage $V_G$, the voltage supplied to the Y electrode lines $Y_1, \ldots, Y_n$ may decrease from the second voltage $V_S$ to the ground voltage $V_G$.

Accordingly, during a subsequent address period PA, addressing can be smoothly performed by applying display data signals to the address electrode lines $A_{R1}, A_{G1}, \ldots, A_{Gm}, A_{Bm}$ and sequentially applying scanning signals of the ground voltage $V_G$ to the Y electrode lines $Y_1, \ldots, Y_n$, which are biased to a fourth voltage $V_{SCAN}$ that is less than the second voltage $V_S$. A positive polarity address voltage $V_A$ is supplied to an address electrode line $A_{R1}, A_{G1}, \ldots, A_{Gm}, A_{Bm}$ to select a discharge cell, and the ground voltage $V_G$ is supplied to an address electrode for a discharge cell that is not to be selected. Accordingly, simultaneously applying the address voltage $V_A$ to one of the address electrode lines $A_{R1}, A_{G1}, \ldots, A_{Gm}, A_{Bm}$ and the scanning signal of the ground voltage $V_G$ to one of the Y electrode lines $Y_1, \ldots, Y_n$ generates an address discharge in the corresponding discharge cell, thereby forming wall charges in the cell. At this time, the X electrode lines $X_1, \ldots, X_n$ may be biased at the first voltage $V_e$ for a more reliable addressing operation.

During a subsequent sustain discharge period PS, alternately applying the a sustain discharge pulse of the second voltage $V_S$ to the Y electrode lines $Y_1, \ldots, Y_n$ and the X electrode lines $X_1, \ldots, X_n$ generates a sustain discharge in selected cells, thereby displaying an image.

FIG. 4 is a graph showing degrees of freedom of gradients with respect to gradient levels when the gradients are expressed by dividing each frame into 10 subfields. FIG. 5 is a table showing subfield coding results with respect to gradient levels when the gradients are expressed by dividing each frame into 10 subfields.

Referring to FIG. 4 and FIG. 5, 256 gradients are expressed by dividing each frame into 10 subfields, and degrees of freedom of gradients and subfield coding results when the 10 subfields having gradient weights of 1, 2, 4, 8, 16, 25, 35, 45, 55, and 64 are shown. Here, each subfield code word of FIG.

5 is performed in the order of SF1, SF2, . . . , SF10. Since each subfield may have a relevant gradient redundancy at each gradient level by expressing the gradients as shown in FIG. 4, generation of a problem can be prevented by substituting a subfield set having a possibility of generating a problem with another subfield set expressing the same gradient.

When gradients are expressed by dividing each frame into 8 subfields as shown in FIG. 2, $2^8$=256 gradients may be expressed. At this time, gradient weights of the 8 subfields are expressed as $2^{n-1}$, i.e., 1, 2, 4, 8, 16, 32, 64, and 128, and there is no gradient redundancy. However, in this case, pseudo-contours generated by changing a subfield set displayed whenever a gradient increases due to an increase of a subfield representing a moving picture cannot be prevented. In this case, this pseudo-contour problem can be solved by expressing gradients using a subfield set with which the problem is not generated by increasing the number of subfields configuring each frame while expressing the same gradient.

A PDP writes data on subfields to be displayed through the address discharge, which is generated by applying data pulses and scan pulses to address electrodes and scanning electrodes, respectively. Since a discharge delay time is necessary to generate the address discharge, the discharge delay time determines the length of an address period.

This address discharge delay time is largely affected by priming due to the address discharge of adjacent cells. That is, when adjacent cells are addressed, the address discharge delay time decreases, resulting in a high probability of a successful address discharge. On the contrary, when adjacent cells are not addressed, the probability of a successful address discharge decreases. Since the probability of successful address discharge may be very low when many addressed cells are not adjacent to other addressed cells, a failure of the address discharge may result in a failure of the sustain discharge, which may result in poor gradient expression. In particular, when the address discharge failure occurs in a subfield having a large gradient weight, since a low gradient discharge effect that a high gradient is intermittently not expressed may occur very severely, the probability of success of the address discharge should be very high in subfields having a large gradient weight.

In a conventional PDP, a value of an input gradient is converted from an integer to a rational number through a gamma block in order to express a low gradient, and an error diffusion block may convert an error of gradient data into the rational number. For example, when a value of a gradient input from the gamma block is a rational number equal to 56.0625, the gradient equal to 56.0625 can be expressed by combining a gradient equal to 56 and a gradient equal to 57 in a proper ratio in order to express 56.0625 using the error diffusion block. When using the subfield coding shown in FIG. 5, subfield code words corresponding to 56 and 57 are '1111110000' and '0110101000', respectively.

When 56.0625 is expressed by a spatial combination of 56 and 57, data switching occurs in SF1, SF4, SF6, and SF7. Since the value is 56.0625, the gradient equal to 56 may be turned on in a distribution ratio of about 93.8% of a predetermined area, and the gradient of 57 may be turned on in a distribution ratio of about 6.2% of the predetermined area. Here, a probability of success of the address discharge of SF7 of the gradient equal to 57 may cause a problem. That is, since SF7 equal to 57 is not turned on in a previous subfield, a priming effect by a sustain discharge of the previous subfield does not exist, and since most of adjacent cells are gradients equal to 56, SF7*s* of the adjacent cells do not have address data. Accordingly, a priming effect by addressing the adjacent cells does not exist. Therefore, an address discharge may be performed under conditions of a very scarce priming effect due to a solo addressing, and this may cause the low gradient discharge effect.

If the subfield codeword equal to 56 is made to be similar to the subfield codeword equal to 57 within a range permitted by a relevant gradient redundancy, a low discharge in a low gradient may be reduced. However, in this case, since the gradient low discharge between 56 and 57 is moved to a gradient low discharge between 55 and 56, this does not mean that a gradient in which the gradient low discharge is generated disappears, rather it means it may transition to another gradient.

That is, when the gradient switching is performed in a subfield having a large gradient weight, the low discharge can be generated in a low gradient, and this may cause a very poor gradient expression of a PDP. In particular, when an input gradient passes through the gamma block, most gradients move to a low gradient region. For example, when an input gradient is 100, a gradient level may decrease to about 20 at a back end of the gamma block. In this case, most gradients may be expressed with subfields having low gradient weights, and when subfields are designed using the subfield weights shown in FIG. 5, since a least significant bit (LSB) subfield does not have a redundancy, the solo addressing by the subfield switching occurs due to the error diffusion. Accordingly, a low discharge effect in a low gradient may be severe.

That is, the error diffusion satisfies $g<x<g+1$ by spatially combining a gradient g+1 with respect to a gradient g in order to express a gradient x including a value below a decimal point. At this time, since the subfield coding of the gradient g and the gradient g+1 according to the gradient x may vary largely, the low discharge effect in rapidly varied subfields may be severe.

SUMMARY OF THE INVENTION

The present invention provides an apparatus for driving a discharge display panel by dual subfield coding, by which a gradient low discharge effect caused by a failure of an address discharge can be prevented using a subfield gradient weight design by which an input gradient has a plurality of redundancies in all gradients except gradients having a least gradient weight and a highest gradient weight, and a dynamic dual subfield coding design.

Additional features of the invention will be set forth in the description which follows, and in part will be apparent from the description, or may be learned by practice of the invention.

The present invention discloses an apparatus for driving a discharge display panel, which divides an image signal into frame units, obtains an input gradient of a frame from the image signal, and performs a time division gradient display on the discharge display panel according to the input gradient by dividing the frame into a plurality of subfields having respective gradient weights. At least two subfields have a least gradient weight.

The present invention also discloses an apparatus for driving a discharge display panel, which divides an image signal into frame units, obtains an input gradient of a frame from the image signal, and performs a time division gradient display on the discharge display panel according to the input gradient by dividing the frame into a plurality of subfields having respective gradient weights. There are redundancies in all input gradients except input gradients having a least gradient weight and a highest gradient weight.

The present invention also discloses an apparatus for driving a discharge display panel, which divides an image signal into frame units, obtains an input gradient of a frame from the image signal, and performs a time division gradient display on the discharge display panel according to the input gradient by dividing the frame into a plurality of subfields having respective gradient weights. The apparatus comprises an image processing unit generating an internal image signal by processing a received image signal, a driving controller generating a driving control signal comprising a scan data signal, an address data signal, and a common data signal according to the internal image signal, and a driver generating a driving signal according to the driving control signal and applying the driving signal to respective electrode lines. The apparatus has at least two subfields having a least gradient weight.

The present invention also discloses a method of driving a discharge display panel, which divides an image signal into frame units, obtains an input gradient of a frame from the image signal, performs a time division gradient display on the discharge display panel according to the input gradient by dividing the frame into a plurality of subfields having respective gradient weights, and has at least two subfields having a least gradient weight. The method comprises generating a gradient level of the input gradient, determining whether an integer part of the input gradient is an even number or an odd number, generating a first group of subfield code words of which each code word of a gradient having one larger gradient level than an input gradient of an even number is a code word of which all bits except a bit having a least weight are equal to bits of a code word of the input gradient of the even number, generating a second group of subfield code words of which each code word of a gradient having one larger gradient level than an input gradient of an odd number is a code word of which all bits except a bit having a least weight are equal to bits of a code word of the input gradient of the odd number, and generating subfields by selecting the first group of subfield code words when an integer part of an input gradient is an even number and selecting the second group of subfield code words when the integer part of the input gradient is an odd number.

The present invention also discloses a method for driving a discharge display panel, which divides an image frame into a plurality of subfields having respective gradient weights, and at least two subfields have a least gradient weight. The method comprises determining an input gradient of a frame, generating a first group of subfield code words and a second group of subfield code words, and selecting either the first group of subfield code words or the second group of subfield code words according to a value of the input gradient.

It is to be understood that both the foregoing general description and the following detailed description are exemplary and explanatory and are intended to provide further explanation of the invention as claimed

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

FIG. 10 is a table showing dual subfield coding results according to an exemplary embodiment of the present invention.

DETAILED DESCRIPTION OF THE ILLUSTRATED EMBODIMENTS

Hereinafter, the present invention will be described more fully with reference to the accompanying drawings, in which embodiments of the invention are shown. The present invention relates to a driving apparatus of a display device that displays pictures on a panel by a discharge. Hereinafter, as a typical example, a driving apparatus using dual subfield coding for realizing gradients in a PDP will be described, but the invention is not limited to a PDP.

Figure 6:
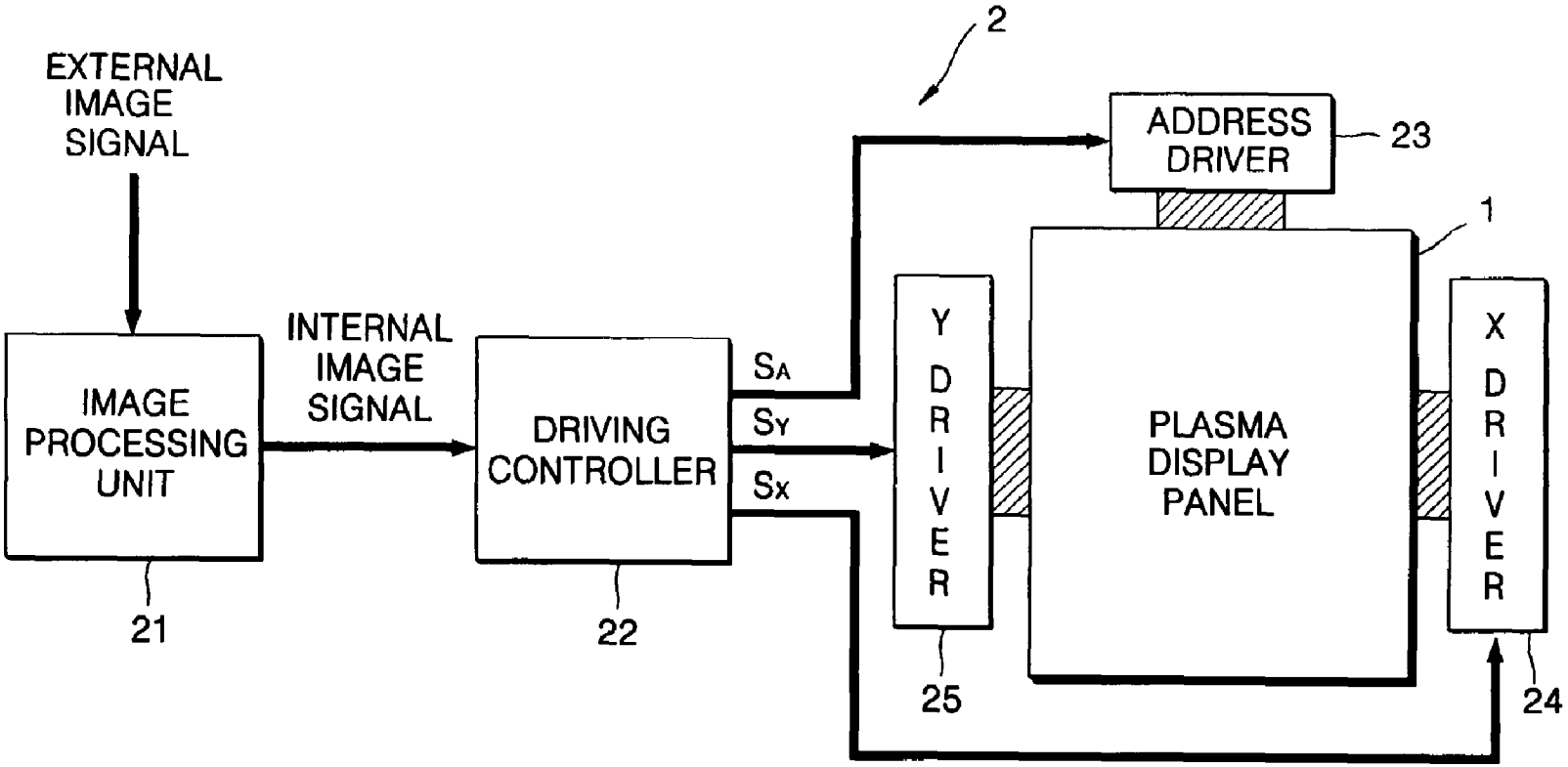
FIG. 6 is a schematic block diagram of a PDP driving apparatus according to an exemplary embodiment of the present invention.
Figure 7:
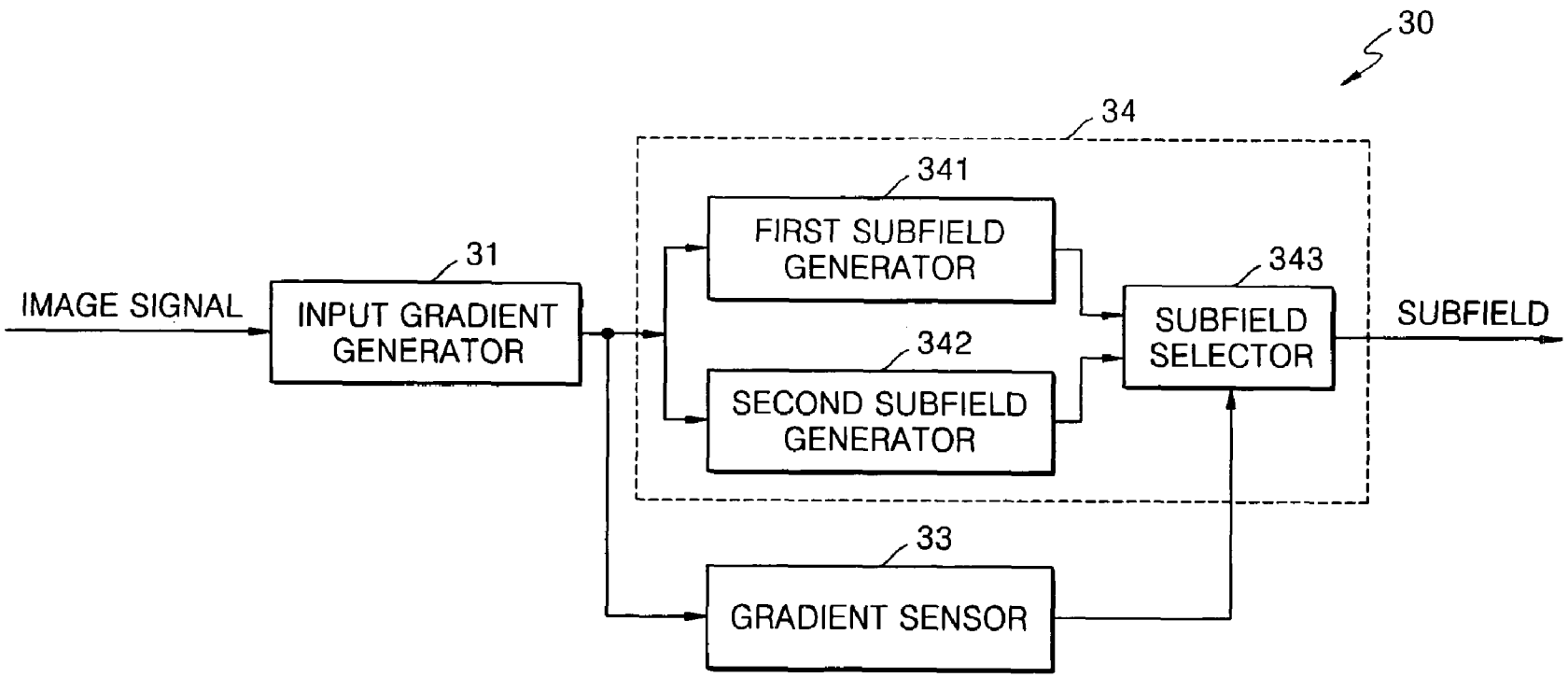
FIG. 7 is a schematic block diagram of a driving controller in the PDP driving apparatus of FIG. 6 according to an exemplary embodiment of the present invention.

FIG. 6 is a schematic block diagram of a PDP driving apparatus according to an exemplary embodiment of the present invention. FIG. 7 is a schematic block diagram of a driving controller of the driving apparatus of FIG. 6. FIG. 10 is a table showing dual subfield coding results with respect to each gradient level in an example of expressing gradients by dividing each frame into 11 subfields.

Referring to FIG. 6, a driving apparatus 2 of a PDP 1 may include an image processing unit 21, a driving controller 22, an address driver 23, an X driver 24, and a Y driver 25. The image processing unit 21 generates internal image signals, such as, for example, 8-bit red (R), green (G), and blue (B) image data, a clock signal, a vertical sync signal, and a horizontal sync signal, by processing an external image signal. The driving controller 22 generates driving control signals $S_A$, $S_Y$, and $S_X$ according to the internal image signals input from the image processing unit 21.

Drivers, such as the address driver 23, the X driver 24, and the Y driver 25, receive driving control signals $S_A$, $S_Y$, and $S_X$, generate respective driving signals, and apply the driving signals to respective electrode lines.

That is, the address driver 23 generates a display data signal by processing the address signal $S_A$ and applies the generated display data signal to address electrode lines. The X driver 24 processes the X driving control signal $S_X$ and applies the processing result to X electrode lines. The Y driver 25 processes the Y driving control signal $S_Y$ and applies the processing result to Y electrode lines.

The driving apparatus 2 of the PDP 1 divides an externally received image signal into frame units, obtains input gradients of each frame, and performs a time division gradient display on a discharge display panel according to the input gradients by dividing each frame into a plurality of subfields having respective gradient weights.

In particular, the driving apparatus 2 has redundancies in all input gradients except input gradients having a least gradient weight and a highest gradient weight.

Also, the driving apparatus 2 can use at least two subfield coding configurations in all gradients displayed on the PDP 1 in order to prevent a failure of a sustain discharge in a specific subfield. Further, the driving apparatus 2 may configure subfields so that the number of subfields having the least gradient weight is at least 2 in order to avoid a subfield configuration in which the failure of the sustain discharge might occur.

That is, for example, when one frame having 256 gradients is expressed using 11 subfields, the subfields can be configured so that weights of the subfields from a least weight subfield to a highest weight subfield are 1, 1, 2, 4, 8, 16, 25, 35, 45, 55, and 63. The description will now be performed on the basis of this configuration.

When the subfields are designed to have such weights, a plurality of redundancies may exist in all gradients except gradients having the least gradient weight of 0 and the highest gradient weight of 255. Therefore, for gradients in a range of 1 to 254, a degree of freedom of the gradient is at least 2, and another subfield configuration in which coding of all upper subfields except a subfield having the least gradient weight is equal to coding of a subfield configuration can be found out.

FIG. 10 shows an example of this dual subfield coding. Referring to FIG. 10, in a first subfield coding, a subfield configuration of a gradient of an even number (g=2n) is equal to a subfield configuration of a gradient of the even number plus one (g=2n+1) except a subfield (LSB) having a least weight. In a second subfield coding, a subfield configuration of a gradient of an odd number (g=2n−1) is equal to a subfield configuration of a gradient of the odd number plus one (g=2n) except a subfield (LSB) having the least weight.

Therefore, when gradients having a consecutive gradient weight are expressed in an adjacent cell, since switching in a subfield having a larger gradient weight does not occur, a priming effect by a discharge of a previous subfield and a discharge of the adjacent cell can be sufficiently obtained. Accordingly, a gradient low discharge effect, due to lack of the priming effect from an adjacent cell or a previous subfield, which may be generated in a conventional subfield design, can be prevented.

A detailed example will be described with reference to FIG. 10. When a gradient equal to 56, which is an even number, and a gradient equal to 57 are sequentially turned on in an adjacent cell, the first subfield coding provides identical subfield configurations for both gradients except for the first subfield having the least weight. Also, when a gradient equal to 57, which is an odd number, and a gradient equal to 58 are sequentially turned on in an adjacent cell, the second subfield coding provides identical subfield configurations for both gradients except for the first subfield having the least weight. Therefore, the first subfield coding or the second subfield coding can be selected by determining whether a gradient to be expressed is an even number or an odd number.

That is, subfields can be selectively selected from at least two subfield coding configurations according to gradient levels of an input gradient, and a subfield code word of a gradient having one larger gradient level than a gradient level of the input gradient permits the switching to occur in only one subfield, preferably only a subfield having the least weight, of a subfield code word of the input gradient.

To do this, the driving apparatus 2 may have a dual subfield generation system in which dynamic dual subfield coding can be designed. Referring to FIG. 7, a driving controller 30 having the dual subfield generation system may include an input gradient generator 31, a gradient sensor 33, and a subfield generator 34. These components can be included in the driving controller 22 of the driving apparatus 2 of FIG. 6.

The input gradient generator 31 generates a gradient level of an input gradient from an image signal. The input gradient may be expressed by a rational number by an inverse gamma correction according to a gradient expression method.

The gradient sensor 33 senses whether an integer part of the input gradient is an even or odd number. The subfield generator 34 generates subfields from the input gradient according to whether the integer part of the input gradient is an even or odd number.

The subfield generator 34 may include a first subfield generator 341, a second subfield generator 342, and a subfield selector 343.

The first subfield generator 341 generates subfield code words of which each code word of gradients having one larger gradient level (g=2n+1) than a gradient level (g=2n) of each input gradient of an even number is a code word of which all bits except a bit having a least weight are equal to bits of a code word of the input gradient of the even number. Here, n is a natural number.

The second subfield generator 342 generates subfield code words of which each code word of gradients having one larger gradient level (g=2n) than a gradient level (g=2n−1) of each input gradient of an odd number is a code word of which all bits except a bit having a least weight are equal to bits of a code word of the input gradient of the odd number.

The subfield selector 343 selects subfields generated by the first subfield generator when an integer part of an input gradient is an even number and selects subfields generated by the second subfield generator when the integer part of the input gradient is an odd number.

Figure 8:
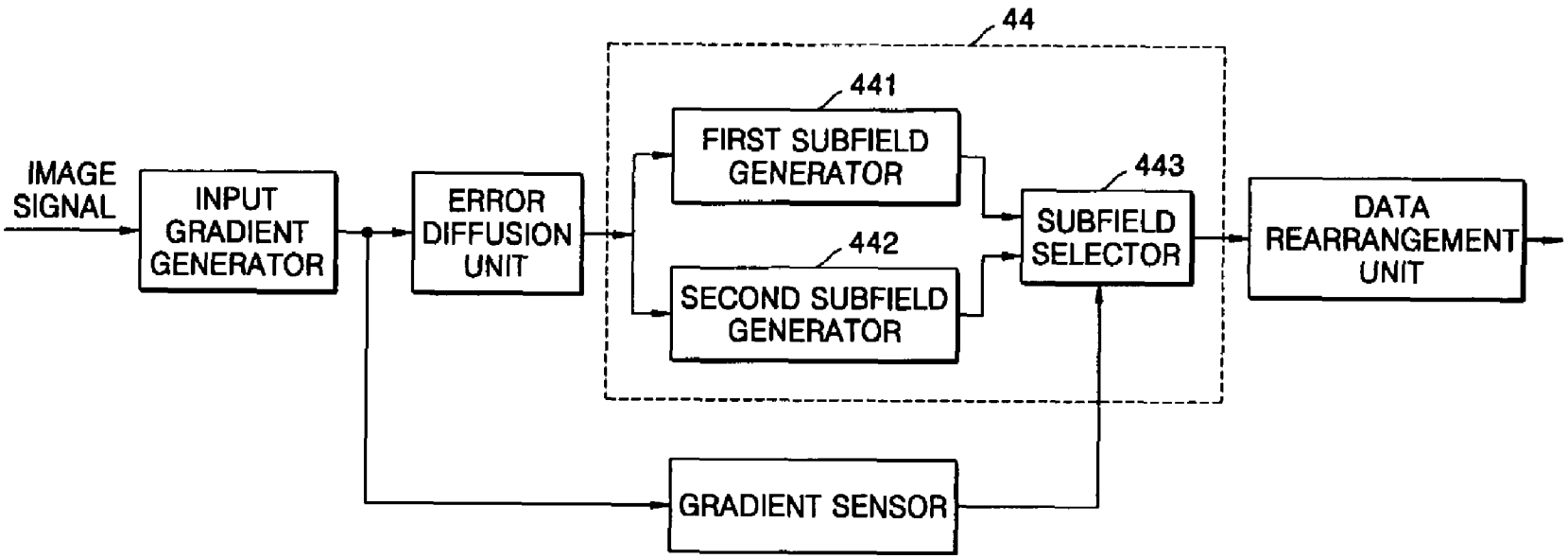
FIG. 8 is a schematic block diagram of a driving controller according to an exemplary embodiment of the present invention.
Figure 9:
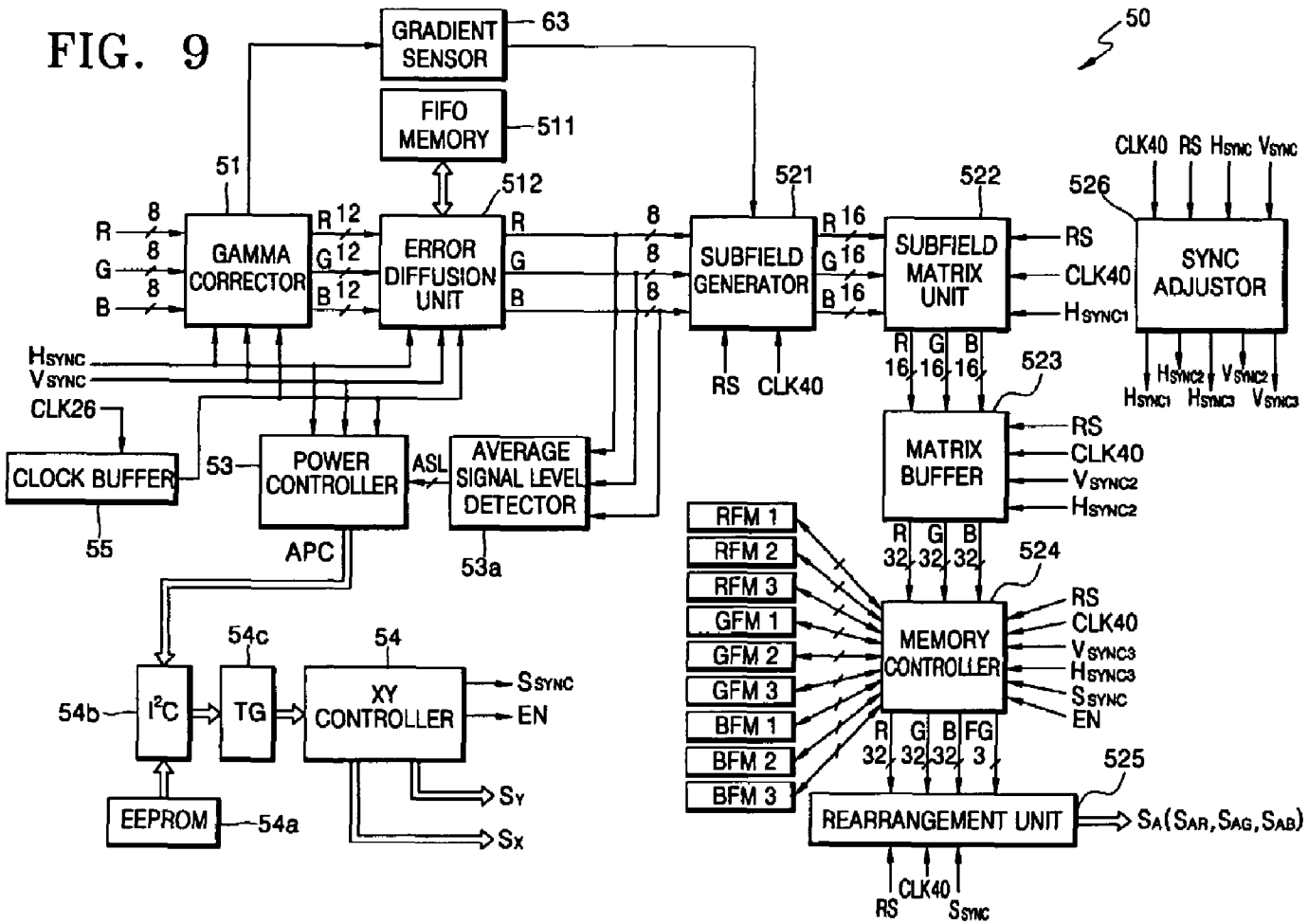
FIG. 9 is a schematic block diagram of a driving controller according to an exemplary embodiment of the present invention.

FIG. 8 and FIG. 9 are schematic block diagrams of a driving controller in the driving apparatus 2 of the PDP 1 of FIG. 6 according to exemplary embodiments of the present invention.

Referring to FIG. 8 and FIG. 9, which show similar embodiments, a subfield generator 521 of FIG. 9 may be the same component performing the same function as the subfield generators 34 and 44 of FIG. 7 and FIG. 8, respectively. A configuration of a driving controller according to an exemplary embodiment of the present invention will now be described with reference to FIG. 9.

Referring to FIG. 9, a driving controller 50 may include a clock buffer 55, a sync adjustor 526, a gamma corrector 51, an error diffusion unit 512, a first-in first-out (FIFO) memory 511, a subfield generator 521, a subfield matrix unit 522, a matrix buffer 523, a memory controller 524, frame memories RFM1, . . . , BFM3, a rearrangement unit 525, an average signal level detector 53*a*, a power controller 53, an EEPROM 54*a*, an $I^2C$ serial communication interface 54*b*, a timing-signal generator 54*c*, an XY controller 54, and a gradient sensor 63.

The gamma corrector 51 receives an image signal of a first number of bits, which has a nonlinear input/output characteristic, and generates a gradient level of an input gradient of a second number of bits, which has a linear input/output characteristic. The second number of bits may be greater than the first. R, G, and B image data input to the gamma corrector 51 may have an inverse nonlinear input/output characteristic in order to correct for a cathode ray tube's (CRT) nonlinear input/output characteristic. Therefore, the gamma corrector 51 processes the R, G, and B image data having an inverse nonlinear input/output characteristic so that the R, G, and B image data has a linear input/output characteristic. That is, an inverse gamma correction may is be required to express gradients, which are suitable for a CRT characteristic, on a PDP having a linear characteristic. For example, since low gradient data is lost after the inverse gamma correction, 12-bit inverse gamma correction gradient data is generated with respect to 8-bit gradient data using a 12-bit look-up table (LUT).

The error diffusion unit 512 generates a quantized input gradient expressed by quantizing the gradient level of the input gradient with a third number of bits, which is smaller than the second number of bits. That is, the error diffusion unit 512 reduces data transmission errors of the R, G, and B image data using the FIFO memory 511, which is a type of dithering method that may be used to express more gradients with a limited number of bits. With a dithering method, a local average is maintained by propagating a quantization error to adjacent cells, and representative algorithms include the Floyd Steinberg algorithm and the Jarvis algorithm.

Here, for example, the first number of bits may be 8, the second number of bits may be 12, and the third number of bits may be 8.

In particular, the gamma corrector 51 may convert an integer input gradient into a rational number and may be more useful to do so since data switching does not occur between adjacent cells in the same subfield when the gradient data converted into a rational number is half-toned by the gamma corrector 51.

For example, when the gamma corrector 51 outputs a rational number gradient of 56.0625, this gradient can be expressed by spatially mixing a gradient equal to 56 and a gradient equal to 57 in proper proportion to the error diffusion. If the gradient of 56.0625 is expressed with 10 subfields having weights of 1, 2, 4, 8, 16, 25, 35, 45, 55, and 64, since 56 can be expressed as '1111110000' and 57 can be expressed as '0110101000', according to this subfield configuration, switching occurs in first, fourth, sixth and seventh subfields when sequentially expressing the gradient equal to 56 and the gradient equal to 57 in an adjacent cell.

However, as described with regard to FIG. 7, since a data switching problem caused by an adjacent cell or a previous field can be solved by adding a least weight field and providing a dual subfield design, in particular, a gradient low discharge problem due to a failure of a sustain discharge in subfields having a large gradient weight can be solved.

Like FIG. 7 and FIG. 8, the gradient sensor 63 senses whether an integer part of the input gradient is an even number or an odd number so that the subfield generator 521 can select a subfield configuration from at least two subfield coding configurations.

The subfield generator 521 quantizes the gradient data converted into the rational number by the gamma corrector 51 according to whether an integer part of each input gradient is an even number or an odd number and generates subfields from the quantized input gradient. Here, referring to FIG. 8, the subfield generator 521 may include a first subfield generator 441, a second subfield generator 442, and a subfield selector 443. Since the functions of the components are the same as those of FIG. 6 and FIG. 7, a detailed description is omitted.

Also, the subfield generator 521 converts 8 bit R, G, and B image data into R, G, and B image data that has the same number of bits as the number of subfields. For example, when a gradient display is performed in a unit frame using 14 subfields, 16-bit R, G, and B image data may be output by converting 8-bit R, G, and B image data into 14-bit R, G, and B image data and adding void data '0' as a most significant bit (MSB) and a LSB in order to reduce a data transmission error.

The clock buffer 55 converts a 26 MHz clock signal CLK26 input from the image processing unit (21 of FIG. 6) into a 40 MHz clock signal CLK40. The 40 MHz clock signal CLK40, an initializing signal RS, and the vertical sync signal $V_{SYNC}$ and the horizontal synch signal $H_{SYNC}$ output from the image processing unit (21 of FIG. 6) are input to the sync adjustor 526. The sync adjustor 526 outputs horizontal sync signals $H_{SYNC1}$, $H_{SYNC2}$, and $H_{SYNC3}$, which are input horizontal signal $H_{SYNC}$ respectively delayed by a predetermined number of clocks, and vertical sync signals $V_{SYNC2}$ and $V_{SYNC3}$, which are input vertical signal $V_{SYNC}$ respectively delayed by a predetermined number of clocks.

The subfield matrix unit 522 simultaneously outputs data of the same subfields by rearranging 16-bit R, G, and B image data whose data of different subfields is simultaneously input. The matrix buffer 523 outputs 32-bit R, G, and B image data by processing the 16-bit R, G, and B image data input from the subfield matrix unit 522.

The memory controller 524 includes a red color memory controller controlling 3 red frame memories RFM1, RFM2, and RFM3, a green color memory controller controlling 3 green frame memories GFM1, GFM2, and GFM3, and a blue color memory controller controlling 3 blue frame memories BFM1, BFM2, and BFM3. Frame data is continuously output from the memory controller 524 in frame units and input to the rearrangement unit 525. A reference character EN denotes an enable signal generated by the XY controller 54 and input to the memory controller 524 in order to control data output from the memory controller 524. Also, a reference character $S_{SYNC}$ denotes a slot sync signal generated by the XY controller 54 and input to the memory controller 524 and the rearrangement unit 525 in order to control 32-bit slot unit data input to, and output from, the memory controller 524 and the rearrangement unit 525. The rearrangement unit 525 rearranges the 32-bit R, G, and B image data input from the memory controller 524 to match an input format of the address driver (23 of FIG. 6), and outputs the address driving control signal $S_A$ comprising R, G, B components $S_{AR}$, $S_{AG}$ and $S_{AB}$.

Figure 1:
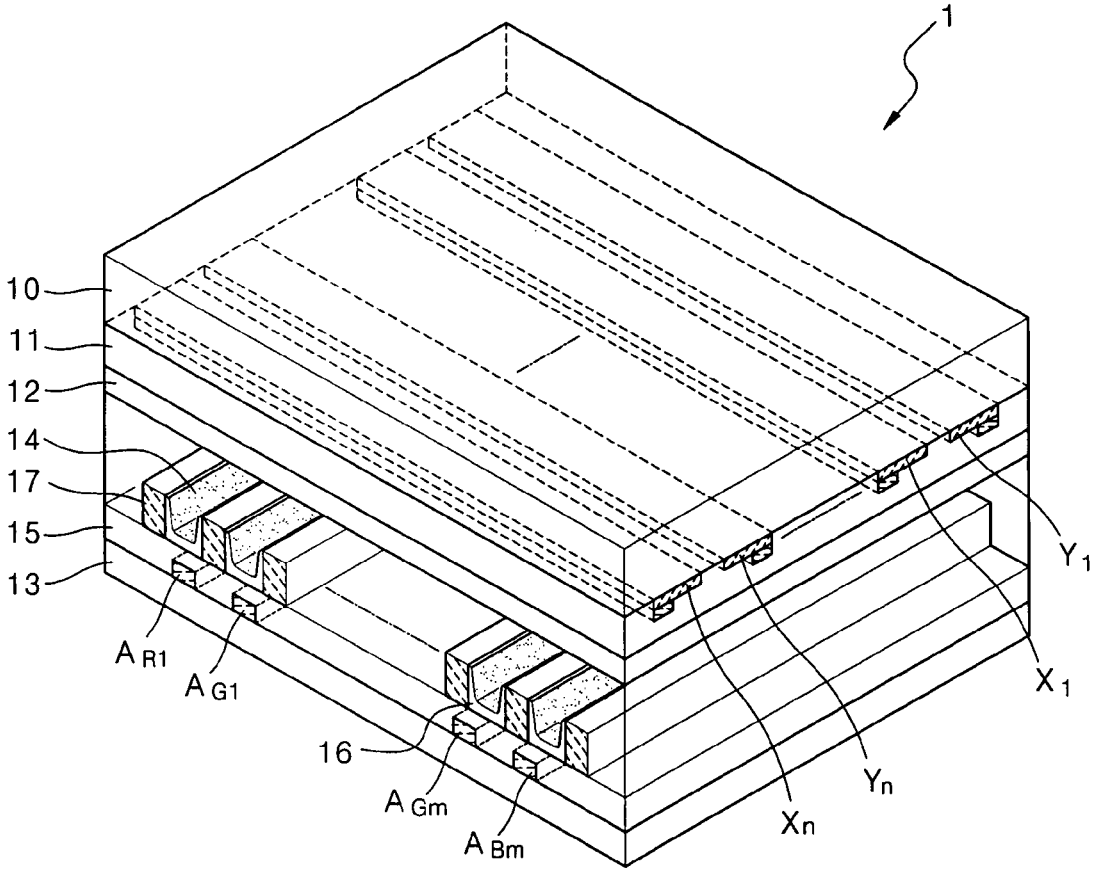
FIG. 1 (PRIOR ART)
FIG. 1 is an internal perspective view showing a structure of a conventional three-electrode surface discharge PDP.
Figure 2:
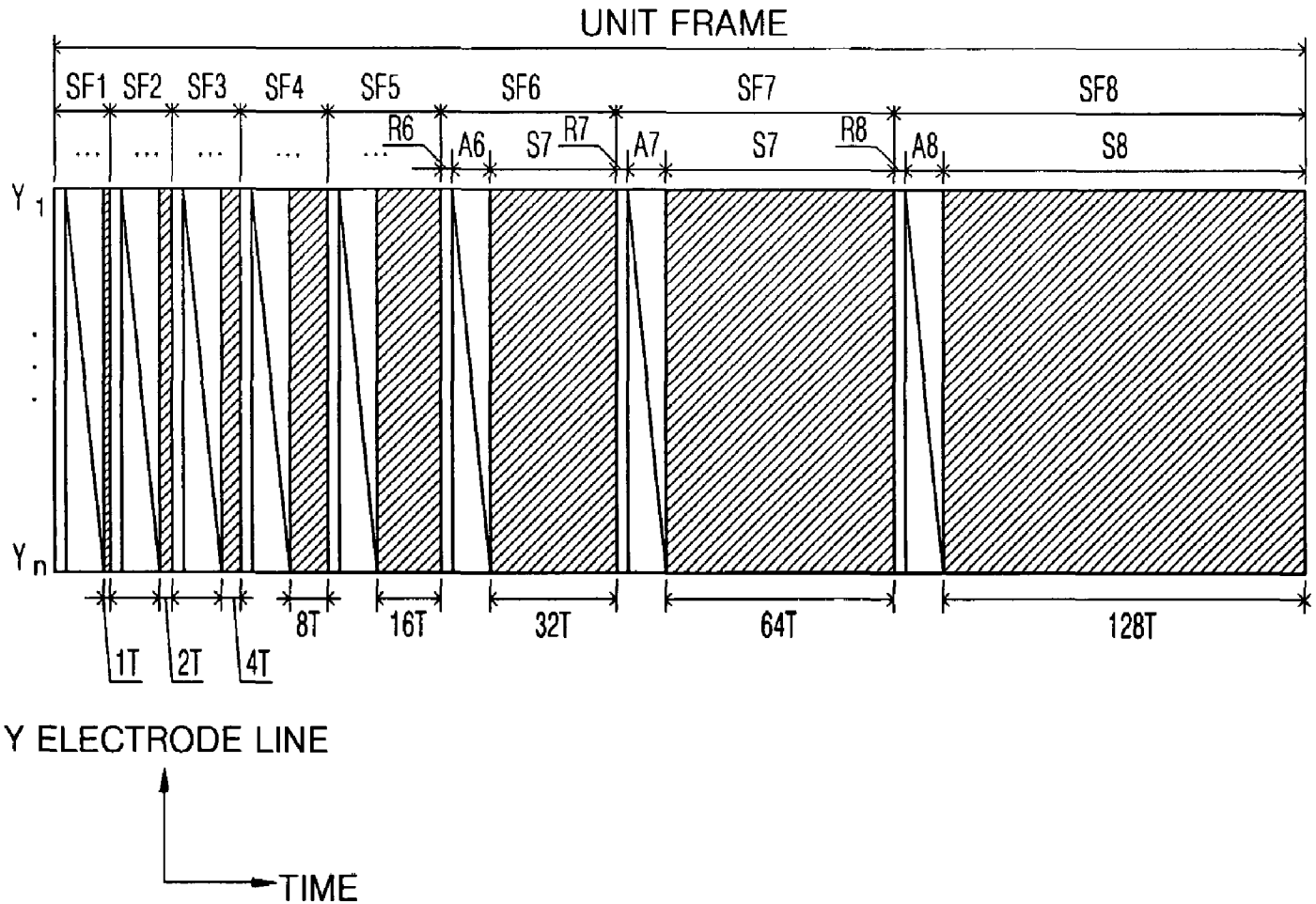
FIG. 2 (PRIOR ART)
FIG. 2 is a timing graph illustrating a driving conventional for the PDP of FIG. 1.
Figure 3:
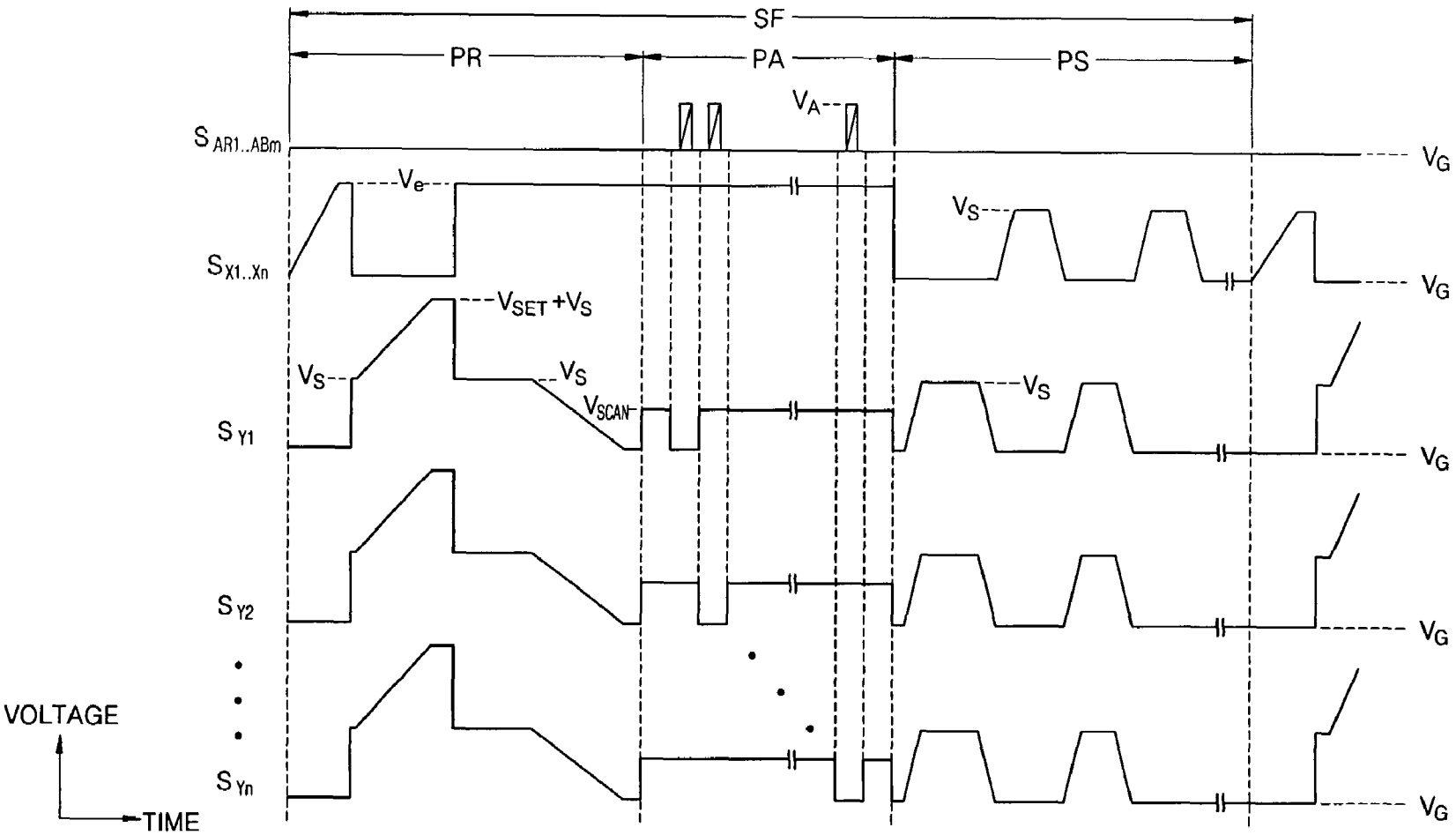
FIG. 3 (PRIOR ART)
FIG. 3 is a timing graph illustrating driving signals that may be applied to electrode lines of the PDP of FIG. 1 in a unit subfield of FIG. 2.
Figures 4, 5:
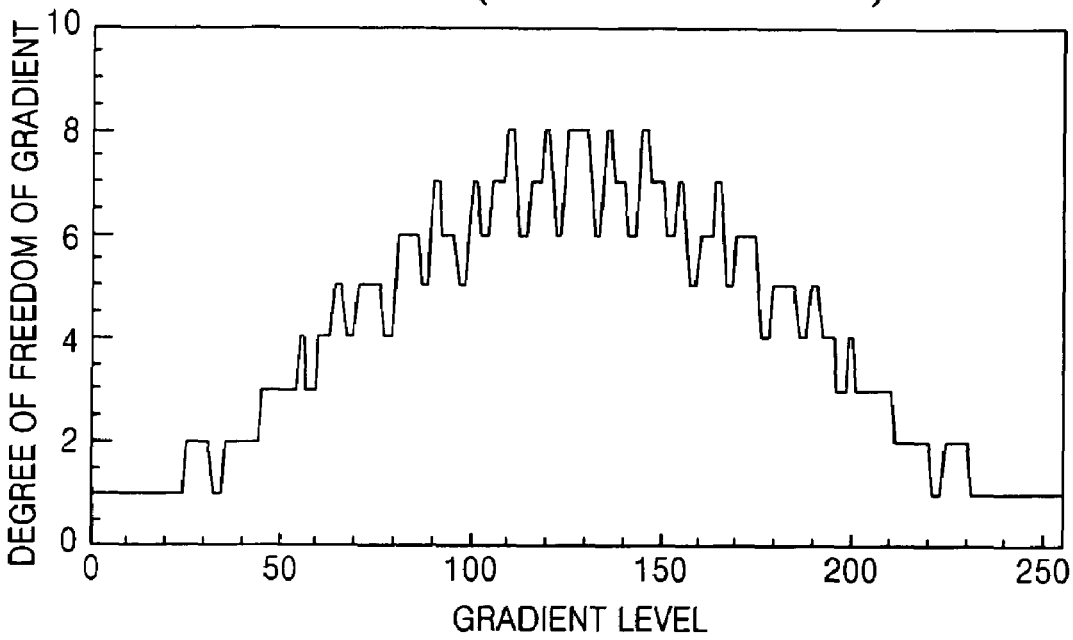
FIG. 4 (PRIOR ART)
FIG. 5 (PRIOR ART)
FIG. 4 is a graph showing degrees of freedom of gradients with respect to gradient levels when the gradients are expressed by dividing each frame into 10 subfields.
FIG. 5 is a table showing subfield coding results with respect to gradient levels when the gradients are expressed by dividing each frame into 10 subfields.

The average signal level detector 53*a* detects an average signal level in frame units from 8-bit R, G, and B image data input from the error diffusion unit 512 and outputs the average signal level ASL to the power controller 53. The power controller 53 performs an automatic power control function of constantly maintaining a power consumption of each component by generating discharge count control data APC corresponding to the average signal level ASL input from the average signal level detector 53*a*. Here, a load factor means an average load factor of load factors of subfields of a relevant frame. A load factor of each subfield means a ratio of the number of cells to be displayed to the entire number of PDP cells. In this embodiment, the power controller 53 may perform the automatic power control function when the load factor of a frame exceeds 30%. Timing control data according to driving sequences of the X electrode lines ($X_1, \ldots, X_n$ of FIG. 1) and the Y electrode lines ($Y_1, \ldots, Y_n$ of FIG. 1) may be stored in the EEPROM 54*a*. The discharge count control data APC output from the power controller 53 and the timing control data output from the EEPROM 54*a* are input to the timing-signal generator TG 54*c* via the $I^2C$ serial communication interface 54*b*. The timing-signal generator TG 54*c* generates a timing-signal by operating according to the input discharge count control data APC and timing control data from the EEPROM 54*a*. The XY controller 54 outputs an X driving control signal $S_X$ and a Y driving control signal $S_Y$ by operating according to the timing-signal output from the timing-signal generator 54*c*.

A method of driving the PDP with a driving apparatus of the PDP of FIG. 6, FIG. 7, FIG. 8, FIG. 9 and FIG. 10 includes: generating gradient levels of the input gradients from the input image signal; sensing whether an integer part of each input gradient is an even number or an odd number; generating subfield code words of which each code word of gradients having one larger gradient level than each input gradient of an even number is a code word of which all bits except a bit having a least weight are equal to bits of a code word of the input gradient of the even number; generating subfield code words of which each code word of gradients having one larger gradient level than each input gradient of an odd number is a code word of which all bits except a bit having a least weight are equal to bits of a code word of the input gradient of the odd number; and generating subfields by selecting subfields generated by a first subfield generator when an integer part of an input gradient is an even number and selecting subfields generated by a second subfield generator when the integer part of the input gradient is an odd number.

The generating of the gradient levels of the input gradients may include receiving an image signal of a first number of bits, generating a gradient level of an input gradient of a second number of bits, and generating a quantized input gradient expressed by quantizing the gradient level of the input gradient with a third number of bits. The second number of bits may be larger than the first number of bits, and the third number of bits may be smaller than the second number of bits.

As described above, a driving apparatus of a PDP according to exemplary embodiments of the present invention may significantly reduce a gradient low discharge effect caused by a failure of an address discharge using a subfield gradient weight design by which a subfield gradient has a plurality of redundancies in all gradients except gradients having a least gradient weight and a highest gradient weight and a dynamic dual subfield coding design.

Also, since probability of successful address discharge may increase, an address period may be shortened. Accordingly, high speed addressing may be possible.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An apparatus for driving a discharge display panel, wherein the apparatus divides an image signal into frame units, obtains an input gradient of a frame from the image signal, performs a time division gradient display on the discharge display panel according to the input gradient by dividing the frame into a plurality of subfields having respective gradient weights, and has at least two subfields having a least gradient weight, and wherein the apparatus generates a first group of subfield code words and a second group of subfield code words for the input gradient and selects either the first group of subfield code words or the second group of subfield code words according to whether an integer part of the input gradient is an even number or an odd number.

2. The apparatus of claim 1, wherein the apparatus comprises:

an input gradient generator to generate a gradient level of the input gradient from the image signal;

a gradient sensor to sense whether the integer part of the input gradient is an even number or an odd number; and a subfield generator to generate subfields from the input gradient according to whether the integer part of the input gradient is an even number or an odd number.

3. The apparatus of claim 2, wherein the subfield generator comprises:

a first subfield generator to generate the first group of subfield code words of which each code word of a gradient having one larger gradient level than a gradient level of an input gradient of an even number is a code word of which all bits except a bit having a least weight are equal to bits of a code word of the input gradient of the even number;

a second subfield generator to generate the second group of subfield code words of which each code word of a gradient having one larger gradient level than a gradient level of an input gradient of an odd number is a code word of which all bits except a bit having a least weight are equal to bits of a code word of the input gradient of the odd number; and a subfield selector that selects subfields generated by the first subfield generator when the integer part of the input gradient is an even number and selects subfields generated by the second subfield generator when the integer part of the input gradient is an odd number.

4. An apparatus for driving a discharge display panel, wherein the apparatus divides an image signal into frame units, obtains an input gradient of a frame from the image signal, performs a time division gradient display on the discharge display panel according to the input gradient by dividing the frame into a plurality of subfields having respective gradient weights, and has redundancies in all input gradients except input gradients having a least gradient weight and a highest gradient weight, wherein at least two subfields have the least gradient weight;

An input gradient generator to generate a gradient level of the input gradient from the image signal;

A gradient sensor to sense whether an integer part of the input gradient is an even number or an odd number; and A subfield generator to generate subfields from the input gradient according to whether an integer part of the input gradient is an even number or an odd number, Wherein the subfield generator comprises:

A first subfield generator to generate subfield code words of which each code word of a gradient having one larger gradient level than a gradient level of an input gradient of an even number is a code word of which all bits expect a bit having a least weight are equal to bits of a code word of the input gradient of the even number;

A second subfield generator to generate subfield code words of which each code word of a gradient having one larger gradient level than a gradient level of an input gradient of an odd number is a code word of which all bits except a bit having a least weight are equal to bits of a code word of the input gradient of the odd number; and A subfield selector that selects subfields generated by the first subfield generator when an integer part of an input gradient is an even number and selects subfields generated by the second subfield generator when the integer part of the input gradient is an odd number.

5. An apparatus for driving a discharge display panel, which divides an image signal into frame units, obtains an input gradient of a frame from the image signal, and performs a time division gradient display on the discharge display panel according to the input gradient by dividing the frame into a plurality of subfields having respective gradient weights, the apparatus comprising:

an image processing unit generating an internal image signal by processing a received image signal;

a driving controller generating a driving control signal comprising a scan data signal, an address data signal, and a common data signal according to the internal image signal; and a driver generating a driving signal according to the driving control signal and applying the driving signal to respective electrode lines, wherein the apparatus has at least two subfields having a least gradient weight, wherein a subfield code word of a gradient having one larger gradient level than a gradient level of the input gradient permits switching to occur in only one subfield of a subfield code word of the input gradient.

6. The apparatus of claim 5, wherein the driving controller comprises:

a gamma corrector to receive an image signal of a first number of bits, which has a nonlinear input/output characteristic, and to generate a gradient level of an input gradient of a second number of bits, which has a linear input/output characteristic;

an error diffusion unit to generate a quantized input gradient expressed by quantizing the gradient level of the input gradient with a third number of bits;

a gradient sensor to sense whether an integer part of the input gradient is an even number or an odd number; and a subfield generator to generate subfields from the quantized input gradient according to whether an integer part of the input gradient is an even number or an odd number, wherein the second number is larger than the first number and the third number.

7. The apparatus of claim 6, wherein the subfield generator comprises:

a first subfield generator to generate subfield code words of which each code word of a gradient having one larger gradient level than a gradient level of an input gradient of an even number is a code word of which all bits except a bit having a least weight are equal to bits of a code word of the input gradient of the even number;

a second subfield generator to generate subfield code words of which each code word of a gradient having one larger gradient level than a gradient level of an input gradient of an odd number is a code word of which all bits except a bit having a least weight are equal to bits of a code word of the input gradient of the odd number; and a subfield selector that selects subfields generated by the first subfield generator when an integer part of an input gradient is an even number and selects subfields generated by the second subfield generator when the integer part of the input gradient is an odd number.

8. The apparatus of claim 5, wherein a subfield can be selectively selected from at least two subfield coding configurations according to the input gradient.

9. A method for driving a discharge display panel, which divides an image signal into frame units, obtains an input gradient of a frame from the image signal, performs a time division gradient display on the discharge display panel according to the input gradient by dividing the frame into a plurality of subfields having respective gradient weights, and has at least two subfields having a least gradient weight, the method comprising:

generating a gradient level of the input gradient;

determining whether an integer part of the input gradient is an even number or an odd number;

generating a first group of subfield code words of which each code word of a gradient having one larger gradient level than an input gradient of an even number is a code word of which all bits except a bit having a least weight are equal to bits of a code word of the input gradient of the even number;

generating a second group of subfield code words of which each code word of a gradient having one larger gradient level than an input gradient of an odd number is a code word of which all bits except a bit having a least weight are equal to bits of a code word of the input gradient of the odd number; and generating subfields by selecting the first group of subfield code words when an integer part of an input gradient is an even number and selecting the second group of subfield code words when the integer part of the input gradient is an odd number.

10. The method of claim 9, wherein generating the gradient level of the input gradient comprises:

receiving an image signal of a first number of bits, which has a nonlinear input/output characteristic, and generating a gradient level of an input gradient of a second number of bits larger than the first number of bits, which has a linear input/output characteristic; and generating a quantized input gradient expressed by quantizing the gradient level of the input gradient with a third number of bits smaller than the second number of bits.

11. A method for driving a discharge display panel, which divides an image frame into a plurality of subfields having respective gradient weights, and at least two subfields have a least gradient weight, the method comprising:

determining an input gradient of a frame;

generating a first group of subfield code words and a second group of subfield code words; and selecting either the first group of subfield code words or the second group of subfield code words according to a value of the input gradient, wherein selecting either the first group of subfield code words or the second group of subfield code words provides a group of subfield code words wherein a subfield code word of a gradient having one larger gradient level than a gradient level of the input gradient is identical to a subfield code word of the input gradient except for a least weight bit.

* * * * *